United States Patent [19]

Takebe et al.

[11] Patent Number: 5,068,651

[45] Date of Patent: Nov. 26, 1991

[54] IMAGE DISPLAY APPARATUS

[75] Inventors: Hideharu Takebe, Itami; Makoto Okura, Kamakura, both of Japan

[73] Assignee: Mitsubishi Denki Kabushiki Kaisha, Tokyo, Japan

[21] Appl. No.: 336,949

[22] Filed: Apr. 11, 1989

[30] Foreign Application Priority Data

Oct. 19, 1988 [JP] Japan ..... 63-264646

[51] Int. Cl.[5] ..... G09G 3/00

[52] U.S. Cl. ..... 340/814; 340/731; 340/789

[58] Field of Search ..... 340/731, 732, 735, 744, 340/745, 748, 790, 814, 798, 799, 749, 750

[56] References Cited

U.S. PATENT DOCUMENTS

| | | | |
|---|---|---|---|
| 4,321,596 | 3/1982 | Hernandez | 340/731 |
| 4,345,244 | 8/1982 | Greer et al. | 340/735 |
| 4,479,119 | 10/1984 | Sakano | 340/731 |
| 4,849,748 | 7/1989 | Katsuta | 340/735 |

*Primary Examiner*—Jeffery A. Brier
*Assistant Examiner*—Chanh Nguyen
*Attorney, Agent, or Firm*—Townsend and Townsend

[57] ABSTRACT

An image display apparatus includes a programmable raster line address generator that repeatedly displays programmably selected raster lines of a stored pattern a predetermined number of times to enlarge the stored pattern when displayed. Programmable registers store integers that select which raster lines are to be repeatedly displayed.

4 Claims, 5 Drawing Sheets

IMAGE DISPLAY APPARATUS

BACKGROUND OF THE INVENTION

1. Field of the Invention

This invention relates to an image display apparatus and, more particularly, to an image display apparatus having a fixed display screen resolution such as a liquid crystal display panel or a plasma display panel.

2. Description of the Prior Art

Recently, display panels such as liquid crystal and plasma display panels have been seeing technical innovation and price reduction, and portable personal computers employing these display panels are used extensively. Such a personal computer employs an image display apparatus using a display panel having a fixed display screen resolution.

Since there are various image display apparatuses, there are a great variety of personal computer software including those which were developed in the past. As a result of technical advancement of display media, however, the display screen resolution (i.e., raster line number of the display image of characters and drawings) for software that was developed in the past is generally low compared to the display screen resolution for newly developed software. Therefore, there are a plurality of different display screen resolutions for software utilized in respective different personal computers. However, since a display panel has a fixed display screen resolution, when it is used to operate software having a display screen having a lower resolution, the display screen is reduced in size compared to the screen size of the display panel. For example, when a display panel having a resolution of 640 dots (horizontal) by 480 dots (vertical) is used for display for a software image screen having a resolution of 640 dots by 350 dots, the display screen size is reduced to 350/480 (i.e., about 73%). In other words, the display can not be seen well even if a high resolution display panel is used.

SUMMARY OF THE INVENTION

The present invention has been intended to solve the above problem, and it has an object of providing an image display apparatus, which permits a satisfactory visible image display in conformity to the resolution of a fixed-resolution display panel and close to the full screen size to be obtained even when an image of a lower resolution than the resolution of the display panel is displayed and also can suppress image distortion due to image enlargement as much as possible to prevent deterioration of the quality of displayed letters or characters.

To attain the above object of the invention, there is provided an image display apparatus, in which memory address generation means repeatedly designates preset raster addresses in a process of designating successive rasters.

The above and other objects, features and advantages of the invention will become more apparent from the following description when the same is taken with reference to the accompanying drawings.

BRIEF DESCRIPTION OF THE DRAWINGS

FIG. 4(*b*) is a view showing the displayed letter or character; and

DESCRIPTION OF THE PREFERRED EMBODIMENT

Figure 1:
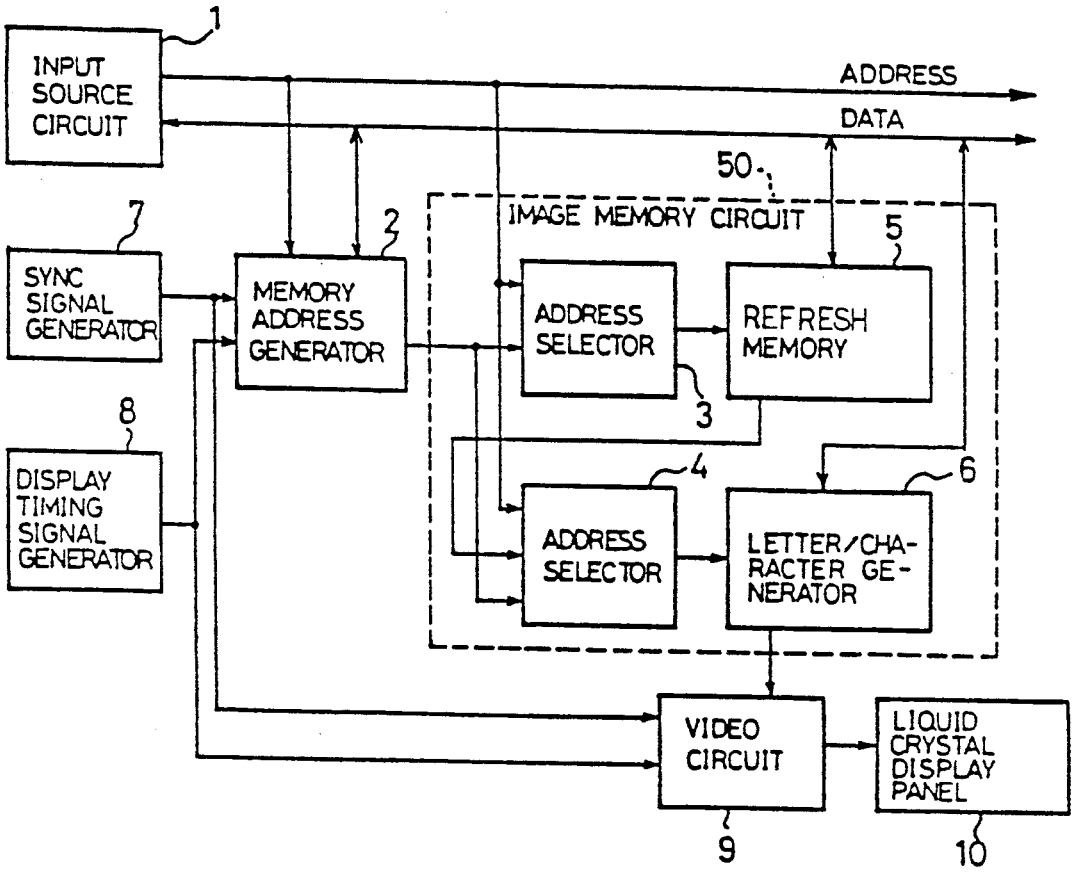
FIG. 1 is a block diagram showing an embodiment of the image display apparatus according to the invention.

An embodiment of the image display apparatus according to the invention will now be described with reference to FIGS. 1 to 5. Referring now to FIG. 1, there is shown the image display apparatus comprising an input source circuit 1, a sync signal generator 7, a display timing signal generator 8, a memory address generator 2, an image memory 50, a video circuit 9 and a liquid crystal display panel 10. The input source circuit 1 is constituted by such an input apparatus as a microprocessor or a keyboard provided with a control circuit for controlling an output unit such as a CPU or a printer. The sync signal generator 7 serves as sync signal generation means to generate sync signals. The display timing signal generator 8 serves as display timing signal generation means to generate display timing signals. The image memory 50 serves as image memory means to memorize image data of a letter or character or drawing pattern for each raster. The memory address generator 2 serves as memory address memory means to successively designate raster addresses in the image memory 50 for reading out image element data. The video circuit 9 converts the image element data noted above into video signal according to sync and display timing signals from the sync and display timing generators 7 and 8. The liquid crystal display panel 10 serves as display means to display the letter or character or drawing pattern noted above according to the output of the video circuit 9.

More specifically, the video circuit 9 provides dot-unit image data, for instance, as the image data noted above, to the liquid crystal display panel 10 after parallel-to-serial conversion and in synchronism to a shift clock. The liquid crystal display panel 10 has a fixed display screen resolution, and its mode is set by the input source circuit 1. In this embodiment, a display screen of horizontal 640 dots by vertical 480 dots is a 19-raster-by-25-letter column mode.

Figure 4A:
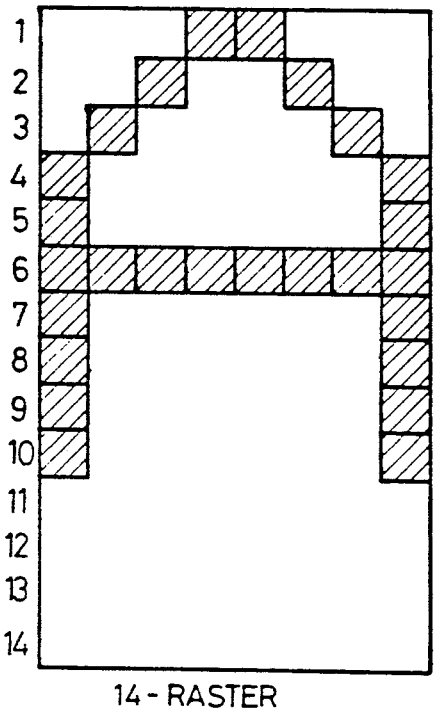
FIG. 4(*a*) is a view showing a letter or character to be displayed.
Figure 4B:
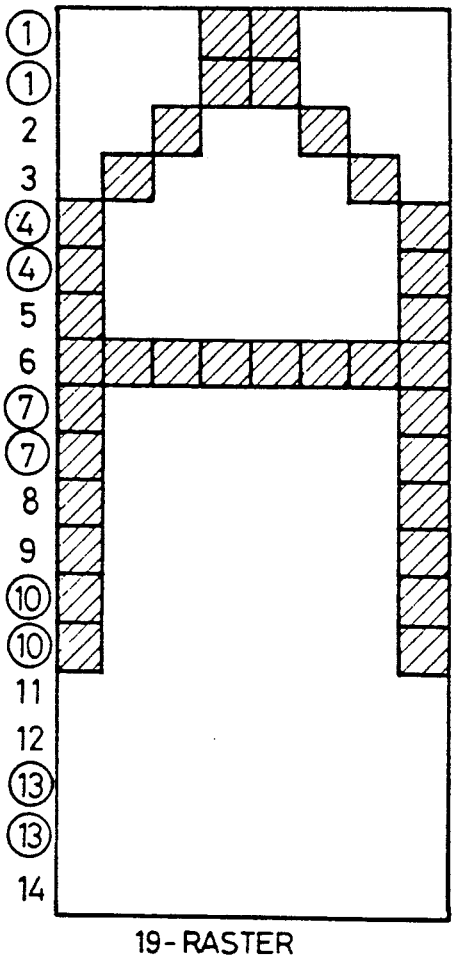

The image memory 50 includes address selectors 3 and 4, a refresh memory 5 and a letter/character generator 6. The address selectors 3 and 4 select and provide addresses from the input source circuit 1 and memory address generator 2. A refresh memory 5 consists of a DRAM or the like, in which codes of patterns of letters, characters, drawings, etc. and letter or character rows or columns are stored. The letter/character generator 6 serves as pattern generation means to generate image element data of a pattern to be displayed, for instance image element data of letter "A" consisting of dots as shown in FIG. 4(*a*) according to the output of the refresh memory 5.

Figure 2:
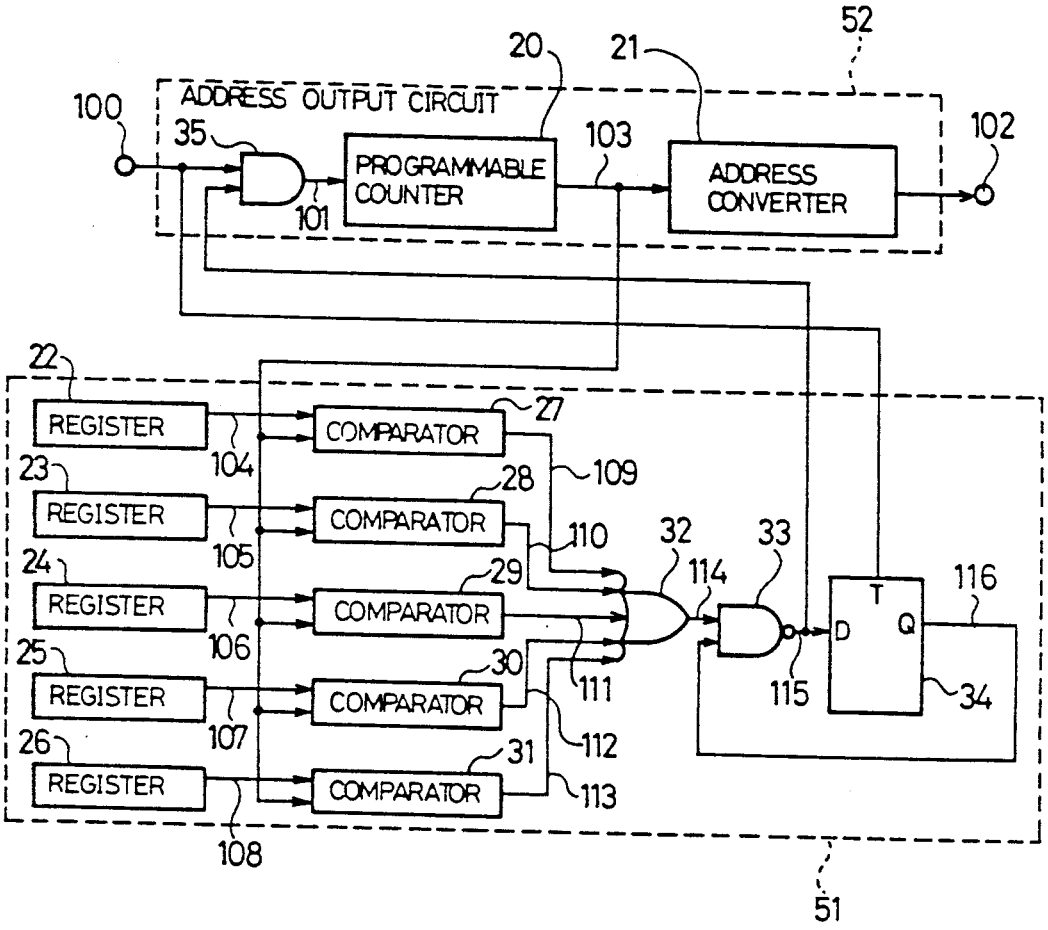
FIG. 2 is a block diagram showing a memory address generator.

FIG. 2 shows the memory address generator 2 in detail. As is shown, the memory address generator 2 includes a raster-setting circuit 51 serving as raster-setting means to set a raster to be repeatedly designated and an address output circuit 52 serving as address output means to successively provide raster addresses according to the output of the rastersetting circuit 51.

The address output circuit 52 has an AND gate 35, a programmable counter 20 and an address converter 21. The raster-setting circuit 51 has registers 22 to 26, comparators 27 to 31, an OR gate 32, an NAND gate 33 and a D-type filpflop 34. A raster to be repeatedly designated by the input source circuit 1 is preliminarily set in the registers 22 and 26. The comparators 27 to 31 compare the outputs of the respective registers 22 to 26 and an output signal 103. The OR gate 32 and NAND gate 33 are provided for logic operation on the outputs of the comparators 27 to 31. The D-type flip-flop 34 is operable according to the output 115 of the NAND gate 33 and a horizontal sync signal 100.

The operation of the apparatus will now be described. The input source circuit 1 provides letter/-character codes to the refresh memory 5 and also provides letter/character image element data to the letter/-character generator 6. The memory address generator 22 provides some of the addresses of the refresh memory 5, in which codes of a letter or character rows, to be displayed are stored, and some of the addresses of the letter/character generator 6, in which image element data of letters or characters are stored, by receiving sync and display timing signals from the sync and display timing signal generators 7 and 8. The address selector 3 selects the address output of the input source circuit 1 when the input source circuit reads or writes, the letter/character rows stored in the refresh memory 5, while it selects the output of the memory address generator 2 when letter/character row code data in the refresh memory 5 are read out for display. The address selector 4 selects the address output of the input source circuit 1 when the input source circuit 1 reads or writes letter/character image element data in the letter/-character generator 6, while it selects the outputs of the refresh memory 5 and memory address generator 2 when letter/character image element data in the letter/-character generator 6 are read out for display. The image element data read out from the letter/character generator 6 for display are supplied to the video circuit 9 for conversion to a video signal conforming to the form of input to the liquid crystal display panel 10 in synchronism to the sync and display timing signals Letters or characters or drawings are displayed on the liquid crystal display panel 10 according to this video signal In the memory address generator 2, the programmable counter 20 up-counts output pulses 101 provided through the AND gate 35 according to the horizontal sync signal 100, and it is reset every time it counts 14 pulses More specifically, although the programmable counter 20 is a modulo-14 counter, its modulo can be set by the input source circuit In this embodiment, it is set as the modulo-14 counter for the display of 14-raster letters or characters The output signal 103 of the programmable counter 20 is supplied to the address converter 21, the output of which is supplied along with the output of the refresh memory 5 as address input to the letter/character converter 6. The output of the refresh memory 5 designates specific data among the letter/-character image element data stored in the letter/-character generator 6, and the output 102 designates specific raster data among the designated letter/character image element data. In the registers 22 to 26, specific values are preliminarily set from the input source circuit 1. In this embodiment, numbers "1", "4", "7", "10" and "13" are set in the respective registers 22 to 26. The comparators 27 to 31 are supplied with the outputs 104 to 108 of the respective registers 22 to 26 as one input and the output signal 103 of the programmable counter 20 as the other input, and they provide output when the only when the preset values of the registers 22 to 26 coincide with the value of the output signal 103. The output 109 to 113 are supplied to the OR gate 32, which in turn provides an output 114 to the NAND gate 33. The output 115 of the NAND gate 33 is supplied as a D input to the D-type flip-flop 34 and also as one input to the AND gate 35. The horizontal sync signal 100 is supplied as a clock T input to the D-type flip-flop 34, the output Q 116 of which is supplied as an input to the NAND gate 33.

Figure 3:
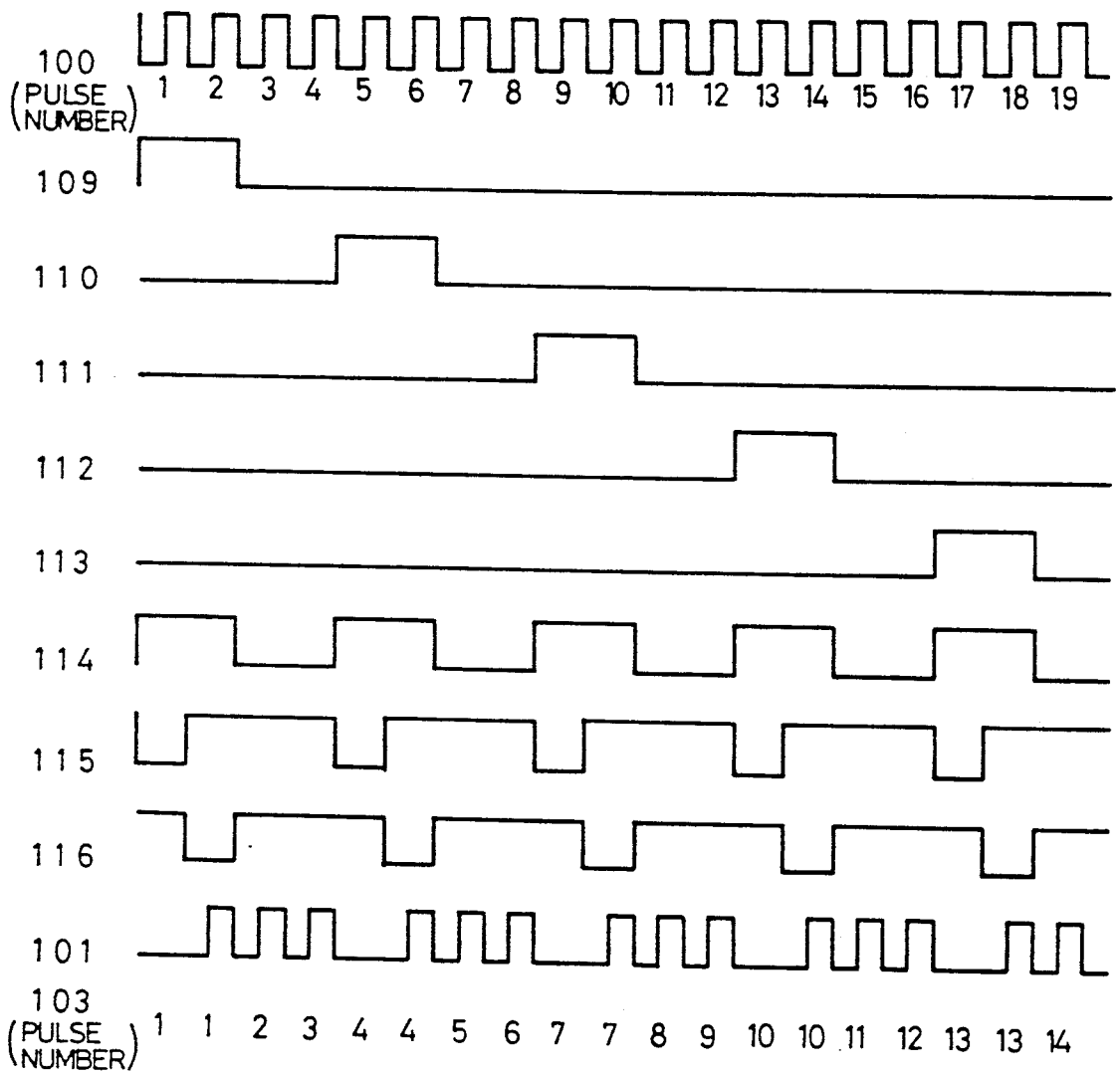
FIG. 3 is a time chart for explaining the operation of the memory address generator.

FIG. 3 shows a timing chart of signals generated in the memory address generator 2. As is shown in the Figure, the outputs 109 to 113 of the comparators 27 to 31 are at a "low" level when their inputs do not coincide and at a "high" level when the inputs coincide. Thus, the output 109 of the comparator 27 is at the "high" level when the output signal 103 of the programmable counter 20 is "1" and otherwise at the "Low" level. Likewise, the outputs 110 to 113 of the comparators 23 to 27 are at the "high" level when and only when the output signal 103 is "4", "7", "10" and "13", respectively. The output 114 of the OR gate 32 is at the "high" level when the output signal 103 of the programmable counter 103, to which the outputs 109 to 113 of the comparators 22 to 27, is "1", "4", "7", "10" and "13" and otherwise at the "low level. When the output 114 is inverted from the "low" to the "high level, the output 115 of the NAND gate 33 is inverted from the "high" to the "low" level if the output Q 116 of the D-type flip-flop 34 is at the "high" level. The inversion of the output 115 to the "low" level is conveyed to the output Q 116 in synchronism to the horizontal sync signal 100, and the output Q 116 is inverted from the "High" to the "low" level with the next clock pulse. At this time, the output 115 of the NAND gate 33 is also inverted from the "low" to the "high" level. It will be seen that the output 115 is at the "low level in the presence of the first clock pulse, at which time the output signal 103 of the programmable counter 20 is "1", "4", "7", "10" and "13" and otherwise at the "high" level. Since the output 115 constitutes an input to the AND gate 35, while it is at the "low" level, the output of the AND gate 35 is at the "low" level, and the horizontal sync signal 100 is not supplied to the programmable counter 20. In other words, the programmable counter 20 counts only 14 pulses while 19 pulses of the horizontal sync signal 100 are generated. That is, for 19 display rasters address inputs for 14 rasters are provided to the letter/character generator 6.

Figure 5:
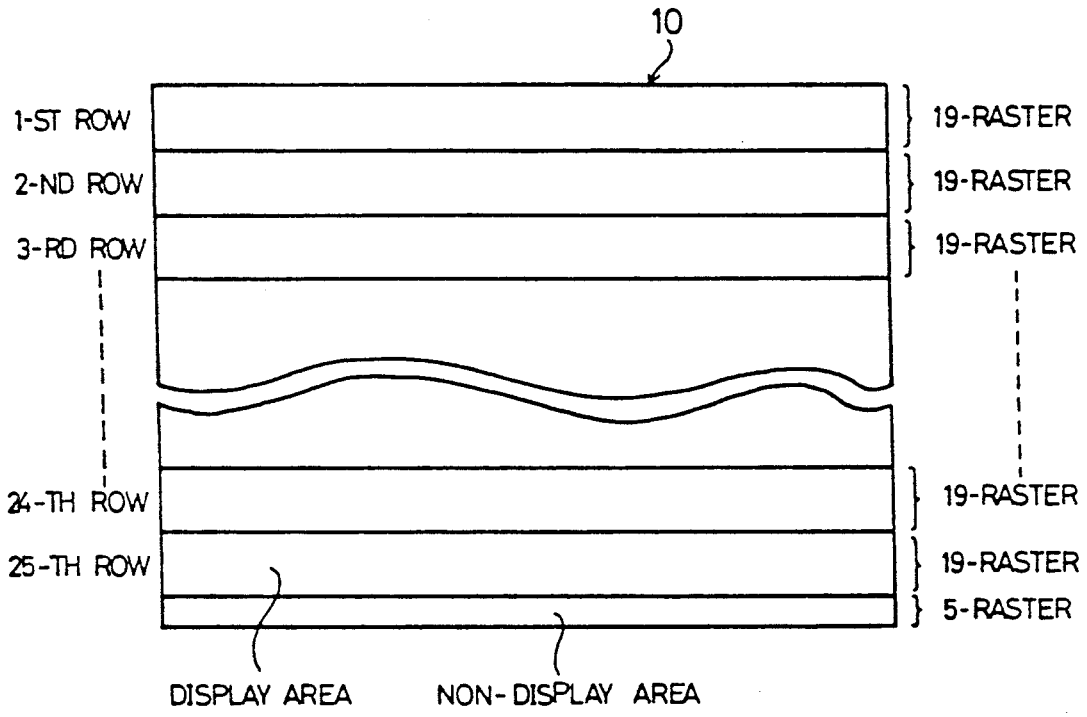
FIG. 5 is a view showing the status of display on a liquid crystal display panel.

It will be seen that by using raster data corresponding to the values "1", "4", "7", "10" and "13" preset in the registers 22 to 26 as the next raster display data, it is possible to display 14-raster letter-character image element data stored in the letter/character generator 6 as shown in FIG. 4(*a*) as a 19-raster letter as shown in FIG. 4(*b*).

Where a 14-raster letter/character image is displayed as an enlarged 25-column display on the 480-raster liquid crystal display panel 10, 25 19-raster letter/character rows are producted with a 5-raster non-display area, as shown in FIG. 5. In case when image is displayed without enlargement on the liquid crystal display panel 10, the display size ratio is 350/480 (i.e., about 73%), whereas in this embodiment a display size ratio of 475/480 (i.e., about 99%) can be obtained. Further, since the raster is enlarged equally for the individual rows, identical letters or characters on different letter or character rows have an identical shape. Thus, the display quality is never deteriorated, and it is possible to obtain a satisfactorily visible image display.

In the above embodiment the liquid crystal display panel 10 is used as display means. However, this is by no means limitative, and it is possible to utilize a plasma display, an electroluminescence display and a CRT as display means as well.

Further, while in the above embodiment a 14-raster letter or character image is displayed as an enlarged 19-raster display, this is by no means limitative, and also it is possible to display drawings as enlarged display. Further, it is possible to possible to enlarge 16- and 10-raster letter or character images and obtain an enlarged 20-rester display. For example, a 16-raster letter or character may be displayed as an enlarged 19-raster letter or character by setting the programmable counter 20 as a modulo-16 counter from the input source circuit 1 and presetting values "3", "9" and "12" in the respective registers 22 to 24 while having the other registers 25 and 26 out of use. Furthermore, while five registers 22 to 26 and five comparators 27 to 31 are provided, this is by no means limitative, and it is possible to provide any desired number of registers or comparators.

As has been described in the foregoing, according to the invention the memory address generation means of the image display apparatus is adapted to repeatedly designate preset raster addresses in the process of designating successive rasters. Thus, it is possible to obtain satisfactorily visible, enlarged image display while maintaining the character of displayed letters or characters and in conformity to the resolution of the display means.

What is claimed is:

1. In an image display apparatus comprising sync signal generation means for generating sync signal pulses, display timing signal generation means, image memory means for storing image element data constituting a pattern, having a predetermined raster line number of raster scan lines, of a letter or a character or a drawing, a video circuit for converting said image element data into a video signal according to signals from said sync and display timing signal generation means and display means for displaying the pattern of a letter or a character or a drawing according to the output of said video circuit, an improved programmable memory address generation unit for generating raster addresses that designates selected raster lines in a selected pattern stored in the image memory means to be repeated a predetermined repeat number of times, said unit comprising:

logic means, coupled to receive the sync signal pulses and a raster line designating signal, for transmitting selected sync pulses only when said raster line designating signal is set;

a counter, coupled to receive said transmitted selected sync pulses, for generating a count signal having a value incremented upon receipt of each selected sync signal pulse and reset when said value is equal to a selected number, said count signal specifying a raster line in the selected pattern;

a plurality of programmable registers for storing a set of integers designating raster scan lines in the selected pattern to be repeated for the predetermined repeat number of selected sync signal pulses; and raster redesignating means, coupled to receive said count signal and said sync signal pulses, and coupled to said registers, for resetting said raster line designating signal for said predetermined repeat number of sync signal pulses to prevent the incrementing of said count signal for said predetermined repeat number of sync signal pulses when the value of the count signal is equal to the value of one the integers in said set so that the raster scan line designated by the count signal is redesignated said predetermined repeat number of times.

2. The image display apparatus according to claim 1, wherein said image memory means includes address selection means for selecting addresses from said memory address generation means, a refresh memory for storing codes of said pattern of a letter or a character or a drawing and pattern generation means for providing image element data of a pattern to be displayed according to the output of said refresh memory.

3. The image display apparatus according to claim 1, wherein said raster designating means includes a plurality of comparators, each having first and second inputs coupled to receive said count signal and the integer stored in a corresponding register, respectively, for indicating when the value of the count signal is equal to the integer stored in the corresponding register.

4. The image display apparatus according to claim 1, wherein said raster designating means includes a delay circuit for delaying resetting of said raster designating signal by the predetermined number of sync signal pulses.

* * * * *